US007503679B2

(12) United States Patent
Godbillon

(10) Patent No.: US 7,503,679 B2
(45) Date of Patent: Mar. 17, 2009

(54) OPTICAL MODULE FOR A MOTOR VEHICLE HEADLIGHT PROVIDED WITH AN OPTICAL DEVIATION ELEMENT

(75) Inventor: Vincent Godbillon, Paris (FR)

(73) Assignee: Valeo Vision, Bobigny (FR)

( * ) Notice: Subject to any disclaimer, the term of this patent is extended or adjusted under 35 U.S.C. 154(b) by 0 days.

(21) Appl. No.: 11/679,333

(22) Filed: Feb. 27, 2007

(65) Prior Publication Data

US 2007/0211485 A1 Sep. 13, 2007

(30) Foreign Application Priority Data

Mar. 7, 2006 (FR) ..... 06 02026

(51) Int. Cl.
*F21V 5/00* (2006.01)

(52) U.S. Cl. ..... 362/522; 362/539; 362/335; 362/475; 362/507; 362/509; 362/514; 362/538

(58) Field of Classification Search ..... None
See application file for complete search history.

(56) References Cited

U.S. PATENT DOCUMENTS

| | | | | |
|---|---|---|---|---|
| 4,087,682 | A * | 5/1978 | Kolodziej | 362/297 |
| 4,928,213 | A | 5/1990 | Nakata | |
| 5,440,456 | A | 8/1995 | Bertling et al. | |
| 5,582,480 | A * | 12/1996 | Zwick et al. | 362/298 |
| 6,435,703 | B2 * | 8/2002 | Takada | 362/517 |
| 6,441,943 | B1 * | 8/2002 | Roberts et al. | 359/267 |
| 6,499,870 | B1 * | 12/2002 | Zwick et al. | 362/505 |
| 6,821,008 | B2 | 11/2004 | Tokoro et al. | |
| 6,908,207 | B2 * | 6/2005 | Jeannot | 362/37 |
| 7,121,705 | B2 | 10/2006 | Albou et al. | |
| 2002/0186570 | A1 * | 12/2002 | Albou et al. | 362/520 |
| 2003/0107901 | A1 | 6/2003 | Tokoro et al. | |
| 2004/0264210 | A1 * | 12/2004 | Albou et al. | 362/538 |

FOREIGN PATENT DOCUMENTS

| | | |
|---|---|---|
| EP | 0325254 | 7/1989 |
| EP | 1243846 | 9/2002 |
| EP | 1302719 | 4/2003 |
| EP | 1491816 | 12/2004 |

* cited by examiner

*Primary Examiner*—Ismael Negron
*Assistant Examiner*—Danielle Dunn
(74) *Attorney, Agent, or Firm*—Jacox, Meckstroth & Jenkins

(57) ABSTRACT

An optical module for a motor vehicle headlight comprising a reflector having an optical axis and at least one focus, a light source placed in the vicinity of the focus to be reflected, and a transparent optical deviation element placed in front of part of the reflector and comprising a lens referred to as a "square lens", the reflector being placed at the rear of the lens, the optical deviation element being able to provide an essentially horizontal spread of the light. The exit face of the "square lens"is tangent to a plane disposed obliquely with respect to the optical axis.

21 Claims, 6 Drawing Sheets

FIG. 8A
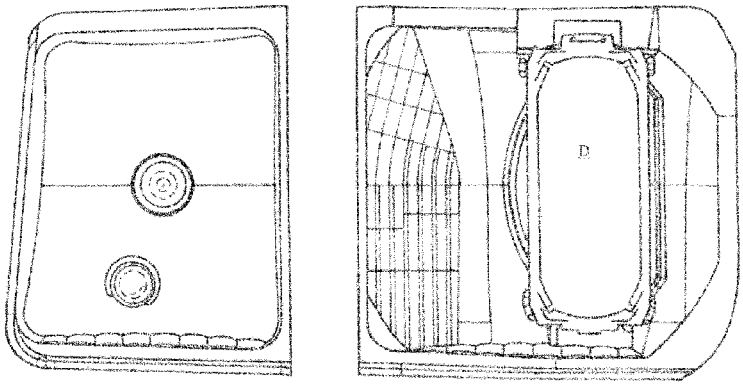
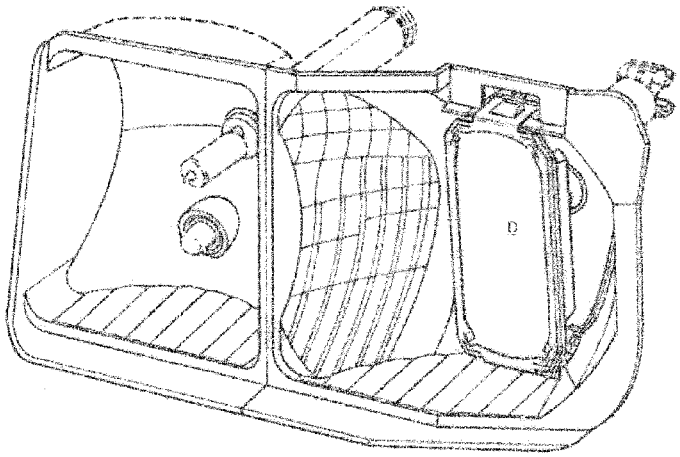
FIG. 8B
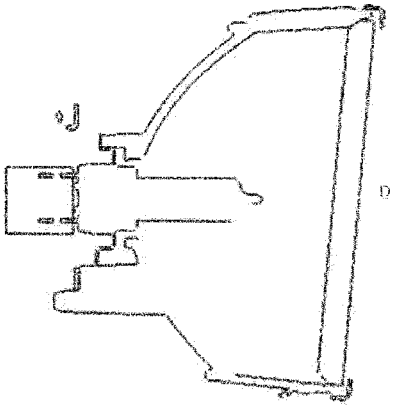
FIG. 8C

OPTICAL MODULE FOR A MOTOR VEHICLE HEADLIGHT PROVIDED WITH AN OPTICAL DEVIATION ELEMENT

BACKGROUND OF THE INVENTION

1. Field of the Invention

The invention relates to an optical module having an optical axis and at least one focus, and a light source, a module intended to be placed in a headlight for a motor vehicle. The module comprises a reflector in the vicinity of the focus of the reflector and a transparent optical deviation element placed in front of part of the reflector, this element consisting of a module comprising a lens referred to as a "square lens" and a reflector placed at the rear of the lens, the module being able to provide an essentially horizontal spread of the light.

2. Description of the Related Art

A headlight comprising a square lens is known from the patent EP 1 243 846. This headlight has the advantage of a relatively small depth (that is to say a size in the direction of the optical axis) and a high light flux.

An improved headlight using this type of lens was proposed in the patent EP 1 491 816: the reflector has a cutout and at least one supplementary reflector disposed on the same side as the cutout, the supplementary reflector being designed to collect the light coming from the light source leaving through this cutout in order to produce a supplementary light beam not intercepted by the lens. The headlight thus keeps a small depth and a high light flux and makes it possible to obtain great range for the beam and, if so desired, to achieve a cutoff for the beam inclined to the horizontal, in particular for a dipped function.

However, these optical modules with a square lens are still susceptible to improvements, in particular on the optical level.

There is, therefore, a need to provide an optical module that improves on the optical systems of the past.

SUMMARY OF THE INVENTION

The aim of the invention is therefore to improve the optical systems of the type mentioned above, in particular in order better to control/exploit the light rays entering these square lens.

The simplifying expression "square lens", for reasons of conciseness, means in the context of the invention a lens that has at least one cylindrical (entry and/or exit) face with vertical generatrices. The contour of the lens is therefore not limited to the square shape but may be rectangular, circular, oval, ovoid, or ogival, or have a contour of the square or rectangular type but with rounded edges or bevels, or any other contour.

An object of the invention is first of all a headlight for a motor vehicle comprising a reflector R having an optical axis Y-Y and at least one focus F1, a light source S placed in the vicinity of a focus of the reflector, and a transparent optical deviation element D placed in front of part of the reflector, and comprising a lens referred to as a "square lens" L. The reflector R is placed at the rear of the lens. The optical deviation element D is able to provide an essentially horizontal spread of the light. The exit face of the "square lens" is chosen tangent to a plane P1 disposed obliquely with respect to the optical axis Y-Y.

"Oblique" means here that the exit face of the lens does not contain the optical axis Y-Y and that the exit face of the lens is also not perpendicular to the optical axis of the reflector but inclined by an angle different from 90°. In other words, considering the module in its most usual configuration, in the mounting position, the optical axis of the reflector is substantially disposed along a horizontal axis, and the exit face of the lens is therefore not, as is usual, perpendicular to the optical axis and disposed substantially on a vertical plane: according to the invention, the lens face is therefore turned/inclined. It may be so in two ways:

it may be inclined towards the front/towards the rear (with reference to the direction of the optical axis, from the source towards the outside of the module, following the general routing of the light beam of the module), with its top edge (the one situated above the optical axis) in front with respect to its bottom edge (the one situated below the optical axis), or vice versa, it may be inclined laterally, with one of its lateral edges further in front than the other, still with respect to the direction of the optical axis, with respect to the general direction of travel of the light, it can also be both inclined towards the front/towards the rear and laterally.

It has turned out that this choice is very advantageous on an optical level. This is because inclining the lens compared with an orientation normally orthogonal to the optical axis makes it possible better to control the path of all the light rays entering the lens. More precisely, this makes it possible, surprisingly and as detailed below, to control the minority "stray" light rays that enter the lens through its entry face and that then have a tendency to be reflected on the internal face of its exit surface, to "go back" in the lens. These rays then tend to undergo uncontrolled reflections on the reflective surfaces of the optical module, which has drawbacks of several types: these "stray" rays may get lost, and no longer be able to emerge through the front face of the module, which may give rise to detrimental losses of light flux. In addition, when a function with cutoff of the dipped type is sought, these rays may in some cases arrive above the cutoff and therefore create dazzle for the driver of the vehicle arriving in the opposite direction.

The solution of the invention is simple. This solution is also very effective since it makes it possible to resume control over the rays emitted by the source, entering the lens but which leave again "backwards" by reflection on the internal face of its exit surface, and in particular to guarantee that these rays leave the module in a controlled fashion, in particular without causing dazzle when the module is fulfilling an optical function with cutoff, of the oblique cutoff or flat cutoff type (dipped, fog, etc).

The invention applies equally well to modules with a single reflector, as described in the patent EP 1 243 846, and to modules with additional reflectors as described in the patent EP 1 491 816. In the latter configuration, where the module emits at least one beam with cutoff, the wall of the reflector of the module comprises at least one cutout on one side of a plane passing through the optical axis of the reflector, and at least one supplementary reflector is disposed on the side of the cutout opposite to the optical axis. This supplementary reflector or reflectors are provided to collect at least part of the light coming from the light source leaving through the cutout, and to produce a supplementary beam that is not intercepted by the lens.

The modification in inclination of the lens must be adjusted as well as possible.

Preferably, the plane tangent to the exit face of the "square lens" is inclined by at least 1.5°, in particular at least 2°, with respect to a plane passing through the normal to the optical axis and cutting the plane on the optical axis. Expressed more simply, when the module is in the mounted position, the plane tangent to the exit face of the lens may be inclined with respect to the vertical by the aforementioned angle. Preferably, this angle is chosen so as to be at most 12°, in particular at most 10°. It is advantageously between 4° and 6°, for example equal to 5°. Above or below these limits, the inclination of the lens has an effect that is either negligible or a less good effect still vis-à-vis the stray rays than the configuration perpendicular to the normal optical axis. This selection is also appropriate in order to have the smallest impact possible on style, on the visual appearance of the module, in the switched-off state and in the switched-on state.

Preferably, the plane tangent to the exit face of the "square lens" is inclined with respect to the plane passing through the normal to the optical axis and cutting the plane on the optical axis, the angular difference being measured positively above the optical axis.

In other words, the top edge of the "square lens" is further forward than its bottom edge with respect to its bottom edge with respect to the general direction of travel of the light emitted by the light source, if the module is considered in the position of mounting in the vehicle, once integrated in the headlight. It turned out that inclining the lens in the other direction did not have the magnitude of impact sought on stray rays.

The lens of the "square lens" is therefore "tilted" without moreover substantially modifying its initial geometry. The vertical generatrices of the entry face of the lens will preferably be situated, like the exit face of the lens, in a plane disposed obliquely with respect to the optical axis: any characteristic mentioned in the present text relating to this oblique plane can therefore apply equally well to the tangent plane of the exit face of the lens and to the vertical generatrices of its entry face.

As mentioned above, it is also possible to turn the lens laterally: the plane tangent to the exit face of the lens is then turned, with respect to an axis perpendicularly cutting the optical axis, in particular with respect to a substantially vertical axis, by an angle of between 0.5 and 20°, in particular around 1 to 10°.

In both cases, the lens, compared with its normal configuration, has therefore undergone a slight rotation from top to bottom and/or from right to left.

The most usual configuration of the optical module according to the invention consists of the plane normal to the optical axis mentioned above being substantially vertical, considering the module being in the mounted position in the vehicle, once integrated in the headlight. Therefore still in the mounted position, the lens has an exit face substantially inclined with respect to the vertical, instead of being in a vertical plane or being tangent to a vertical plane.

According to a variant of the invention, the wall of the reflector of the module has two cutouts situated on each side of a plane passing through the optical axis, in particular respectively above and below a horizontal plane passing through the optical axis or respectively to the right and left of a vertical plane passing through the optical axis. At least one supplementary reflector is associated with each cutout and is disposed on the side of the cutout opposite to the optical axis in order to produce a supplementary beam that is not intercepted by the lens.

Advantageously, each cutout is associated with a supplementary reflector, the two supplementary reflectors being asymmetric:

the principal reflector, which is associated with the square lens, is adapted to generate a broad and ample light beam, with a high light flux, one of the supplementary reflectors, in particular the one with the smallest surface, is generally adapted to generate a so-called "comfort" light beam, which reinforces the illumination around 30 meters in front of the vehicle, the other supplementary reflector preferably serves to generate a so-called "long range" beam intended to reinforce the lighting beyond 35 meters in front of the vehicle.

Another object of the invention is to provide any motor vehicle headlight including an optical module as described above.

Advantageously, the wall of the reflector comprises at least one cutout on one side of the plane that is vertical, horizontal or oblique with respect to the vertical and passing through the optical axis. The invention thus provides several embodiments, where the general orientation of the optical system associating the lamp, the reflectors and the cutouts may be either vertical or horizontal or take any desired orientation with respect to the vertical, this in particular in order to take into account aesthetic considerations or dimensional requirements relating to the vehicle that will be equipped with the headlight in question.

The lamp used may be of the filament lamp type, the orientation of which may be axial, transverse or oblique. The optical axis cited above is therefore merged with the axis of the filament of the lamp when it is chosen to have axial orientation. The lamp may also be a Xenon lamp or a light-emitting diode or an assembly of several of these diodes.

In the context of the invention, the spatial references used of the "vertical", "horizontal", "lateral" or "oblique" type are to be understood according to the positioning of the relevant elements of the module, once the module is integrated in a headlight mounted in the vehicle.

The square-lens module is advantageously optimized for total flux collected, with regard to its horizontal directing curve, for a given depth of the headlight and with the greatest focal length possible.

The square-lens module can also be optimized for total collected flux with regard to the height of its vertical section, for a given depth of the headlight and with the greatest focal length possible, in particular when the cutout or cutouts are on one side of a vertical or oblique plane passing through the optical axis.

The height of the reflector and of the lens that faces it is preferably chosen so as to ensure the best collection possible of the light flux (for the focal length obtained when the vertical generatrix is optimized and having regard to the acceptable limit depth, this determines the height of the vertical section of the reflector; this height is the highest of the square-lens module whose useful apparent surface then takes the appearance of an oval).

A horizontal parallel beam is not, or substantially not, deviated vertically.

Preferably, the wall of the reflector has two cutouts situated on each side of a plane passing through the optical axis, at least one supplementary reflector being associated with each cutout and disposed on the side of the cutout opposite to the optical axis in order to produce a supplementary beam that is not intercepted by the lens. The cutouts will be respectively above and below a plane chosen so as to be horizontal passing through the optical axis or respectively to the right and left of a plane chosen so as to be vertical passing through the optical axis. Naturally the plane can also be oblique, as already mentioned.

In order to define, in an equivalent fashion, the position of the supplementary reflector or reflectors with respect to the cutout or cutouts associated with them, it can be stated that these reflectors be situated on the side where the light escapes through the cutout.

The two cutouts may be separate or, on the contrary, be joined and thus form a single cutout, in the shape of an L or a T for example. It is then possible to obtain an optical system also, schematically, in an L, V or T shape, and not only of horizontal or vertical "linear" appearance.

Advantageously, the limit of the supplementary reflector (or at least one of them if there are several of them) on the light source side is such that no light is lost between the reflector R and the supplementary reflector, at the cutout. To achieve this, preferably, the supplementary reflector reaches at least the shallow limit created by the reflector R in the beam emitted by the light source.

The supplementary reflector or reflectors preferably have a complex surface. They are designed to increase the range of the light beam. Advantageously, the supplementary reflector or reflectors are also designed to create a cutoff in the light beam inclined to the horizontal, in particular by 15°.

The supplementary reflectors are separated from the lens, in particular vertically or horizontally according to their arrangements, by a sufficient distance to prevent the beam returned by these reflectors interfering with the lens.

The surfaces of the supplementary reflectors may be limited by the plane tangent to the exit surface of the lens and orthogonal to the optical axis, in order not to increase the overall depth of the system.

Advantageously, at least one space created between a supplementary reflector and the reflector of the lens is used to fulfill another lighting or signalling function, without increasing the overall bulk. In particular, it is possible to install a DRL function (Day Running Light) between a top supplementary reflector and the top edge of the lens. The illuminating surface, in order to fulfill the DRL function, can be increased by at least part of the surface of the lens, illuminating one edge of the lens (in particular its top edge or its lateral edge depending on whether the arrangement of the reflector is of the vertical or horizontal type), by means of the beam created by the DRL reflector.

Advantageously, the additional functions are fulfilled by means of simple reflectors so that all the reflectors can be produced in a single piece, which can be removed from the mold in the direction of the optical axis.

It is possible in particular to envisage, as an additional function, apart from the DRL already cited, the following functions: side light, direction indicator light or DIL, fog light or FL, fixed bending lights or FBL (standing for "Fixed Bending Light" in English.)

When additional light functions using light emitting diodes are added, the diodes are preferably disposed below a horizontal plane containing the optical axis of the light source providing the dipped function, so as to be less exposed to heating.

In order to improve the light beam of a dipped headlight, in particular in the configuration with a substantially vertical cutout, a supplementary reflector in two parts is provided, namely an end part giving the smallest images, essentially providing a long range and the inclined area with cutoff, and a special part, closer to the optical axis, designed to spread its images under the cutoff towards the apex of the V.

In order to optimize the value of the illumination at points whose positions are determined relative to the apex of the cut-off V, or to increase the robustness of the system in terms of dazzle with respect to the relative position intolerances (by providing alignment of the cutoffs issuing from the various elements), it is possible to provide means for vertically moving the light beam issuing from the square lens with respect to the beam of the supplementary reflectors. A lowering of the beam of the square lens is obtained by rotation of the exit face of the lens about its top horizontal edge. This rotation can be provided by a prism added against the exit face of the lens or by an appropriate definition of the exit face of the lens in order to obtain the same effect.

It is possible to favor the top, the bottom or the lateral part of the system in order to place the supplementary reflectors there. The system can have an asymmetric configuration better adapted to integration in a given headlight. The light source formed by a lamp can then be placed so as to be offset, in the direction of the supplementary reflectors, with respect to the square lens. Such a positioning makes it possible to obtain a surface that is more closed in the direction opposite to that of the offset.

In order to keep a sufficient range of the light beam, it is possible to provide, for the supplementary reflectors, surfaces that, on the favored side, project beyond the exit plane of the lens. The depth along the optical axis of the main reflector is then greater, but this depth along a normal to the oblique exit cover of the headlight may be smaller.

The surfaces of the supplementary reflectors can comprise serrations delimiting facets, in particular at least one central facet and two lateral facets.

The invention will be detailed below in the light of non-limiting example embodiments described with the help of the following figures:

These and other objects and advantages of the invention will be apparent from the following description, the accompanying drawings and the appended claims.

BRIEF DESCRIPTION OF THE DRAWINGS

FIGS. 8A, 8B and 8C are a representation of a portion of a headlight according to a particular embodiment, in three different views.

DESCRIPTION OF THE PREFERRED EMBODIMENTS

All these figures are schematic, in order to facilitate reading thereof, and are not necessarily to scale.

Figure 1:
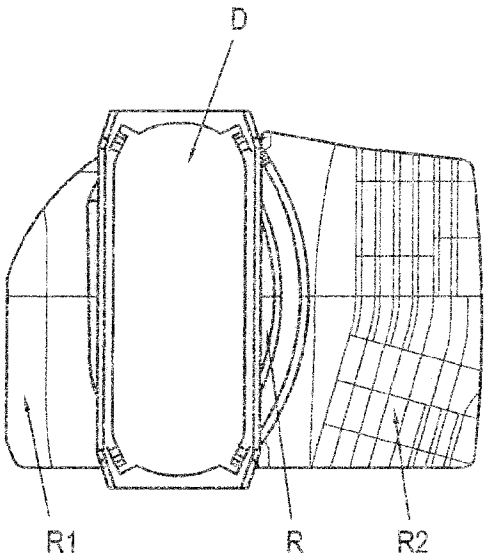
FIG. 1 is a schematic front view of an optical module according to the invention of the horizontal orientation type.

The common elements between the comparative example (FIGS. 3A and 3B) and the example according to the invention (FIGS. 1, 5A and 5B) are described below.

Referring to FIGS. 1, 3A, 3B, 5A and 5B, an optical module MO for a motor vehicle can be seen comprising a main reflector R (common element) having an optical axis Y and at least one focus, a light source S placed at the vicinity of the focus, and a transparent optical deviation element D placed in front of the main reflector R. The general orientation of the optical system is horizontal, the optical module MO being disposed in the position provided in the vehicle.

The optical deviation element D consists of a square lens having at least one cylindrical face with vertical generatrices, able to provide a horizontal spread of the light without any substantial influence in the vertical direction. One of the faces of the square lens, the exit face FS turned towards the front, is planar, orthogonal to the optical axis Y. The other face, turned towards the rear and constituting the entry face FE, is cylindrical in shape with vertical generatrices bearing on a horizontal directrix curve. The directrix can comprise a central part convex towards the front lying between two concave parts. The contour of the square lens is generally rectangular or square, but this lens could be cut along a circular or other contour. In this example, the contour of the lens square is substantially rectangular, the longest side of the rectangle being disposed substantially vertically. The optical deviation element D is fixed to the main reflector R by an element, not shown, which entirely grips its periphery. A lens of this type is described in EP-A 1 243 846, to which reference can be made for more details on the geometry of the lens.

The main reflector R constitutes an essentially convergent mirror (the edges may be parabolic, and the reflector may therefore have areas that are locally non-convergent), whilst the optical deviation element D is partially divergent.

The light source S is here an incandescent lamp, with a filament aligned with the optical axis Y. It may also be a gas discharge lamp known as a Xenon lamp.

Figure 5B:
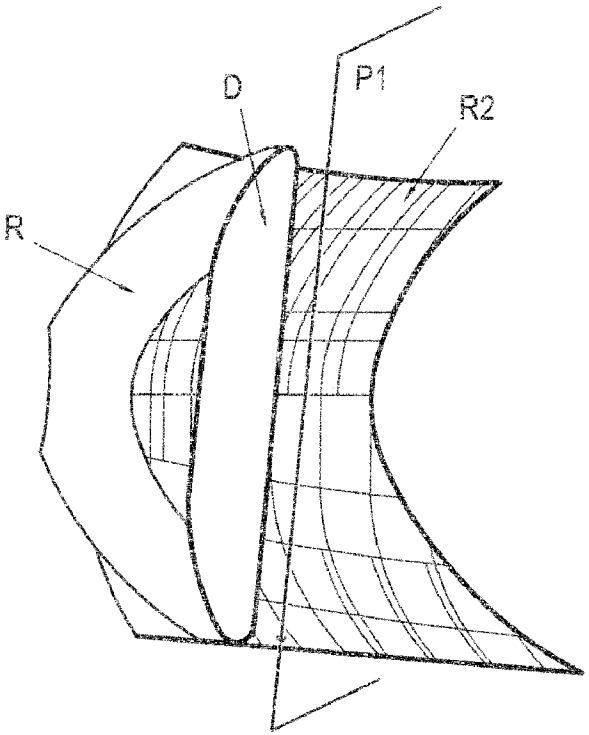
FIGS. 5A and 5B are vertical sections of the optical module according to the invention, passing through the middle of the lens.
Figure 5A:
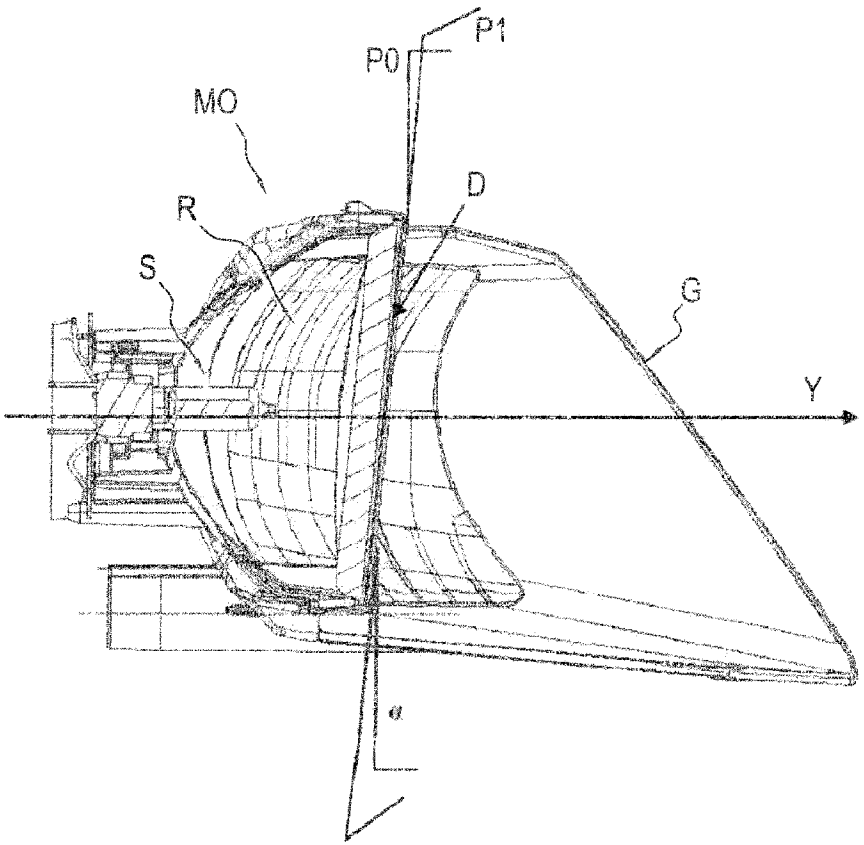

The module is intended to be integrated in a headlight casing B closed at the front by an outer lens G (FIG. 5A).

In the comparative example, as in the example according to the teaching of the invention, the main reflector R has two cutouts in which there are disposed two horizontally oriented supplemental reflectors R1, R2. For more details on the function of these supplemental reflectors R1, R2 reference can be made to the aforementioned patent EP 1 491 816.

In the module of the invention, the supplemental reflector R1, of the complex surface type, is intended to improve comfort, that is to say to increase the illumination procured by the module at 30 meters from the vehicle, and therefore at moderate distance.

And the supplemental reflector R2 of the invention, also of the complex surface type, is intended to have long range, that is to say to increase the illumination beyond 35 meters.

The main reflector R associated with the optical deviation element D is intended to create a broad beam with a high light flux.

The choice of the focal lengths of the supplemental reflectors R1 and R2 is adjusted to the best possible extent according to the invention: for the supplemental reflector R2, a focal length of 22 to 26 mm is appropriate, which makes is possible to splay this parabolic sector sufficiently in order to have small images and create the maximum concentration zone and the part of the beam corresponding to a v-shaped cutoff of the European dipped type. For the supplemental reflector R1, the focal length is preferably less than that of supplemental reflector R2, in particular around 15 to 20 mm, which makes it possible to "close up" the supplemental reflector R1 more: for an equal width of the optical module, more light flux is recovered, or, by reducing the size of the module, a satisfactory light flux level is kept.

Advantageously, focal lengths are chosen for supplemental reflectors R1 and R2 that remain at least 10 mm (in particular between 15 and 28 mm): this choice makes it possible to leave in shadow all the connecting areas between the main reflector R and the supplemental reflectors R1 and R2 relative to the light source S (light cone whose vertex starts from the light source S and bearing on the edge of the main reflector R). Using focal lengths as small as this is generally difficult for conventional reflectors. It is possible in the context of the present invention, since the width of the beam of the module is here obtained by the optical deviation element D associated with the main lens, the surfaces of the supplemental reflectors R1 and R2 can be closed without risk of intercepting the rays coming from the main reflector R.

Figure 2A:
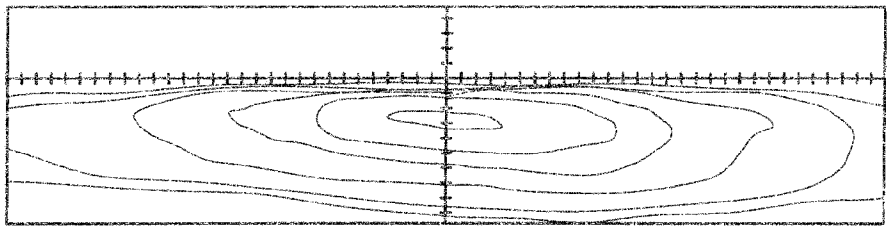
FIGS. 2A, 2B and 2C are representations of isoluxes of the complementary beams generated with the reflectors of the optical module according to FIG. 1.

FIG. 2A shows the isoluxes obtained with the main reflector R, with a sharp horizontal cutoff (measured at 25 m).

Figure 2B:
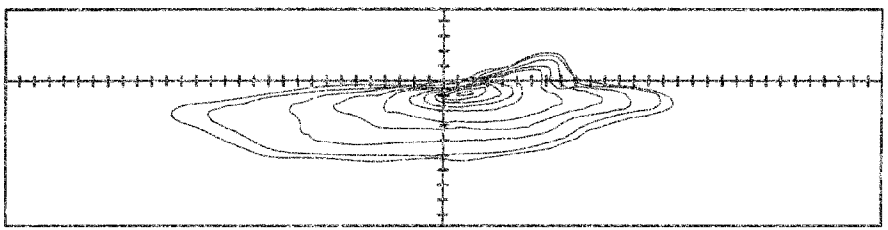

FIG. 2B shows the isoluxes obtained with the supplemental reflector R2 (measured at 25 m).

Figure 2C:
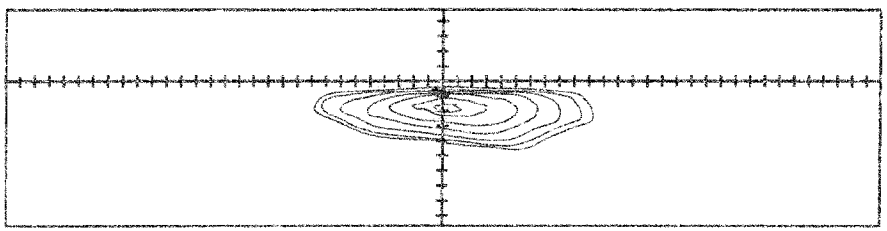

FIG. 2C shows the isoluxes obtained with the supplemental reflector R1 (measured at 25 m).

The superimposition of the isoluxes of these three isoluxes corresponds to the beam emitted overall by the module, a beam of the dipped type with oblique cutoff at 15°.

Figure 3B:
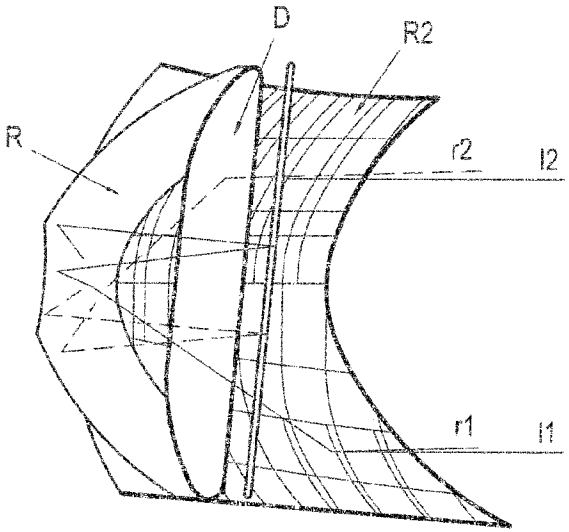
FIGS. 3A and 3B are sections respectively in plan view passing through a horizontal plane containing the optical axis of the main reflector of the module, and a side view passing through a vertical plane passing through the same optical axis according to the prior art.
Figure 3A:
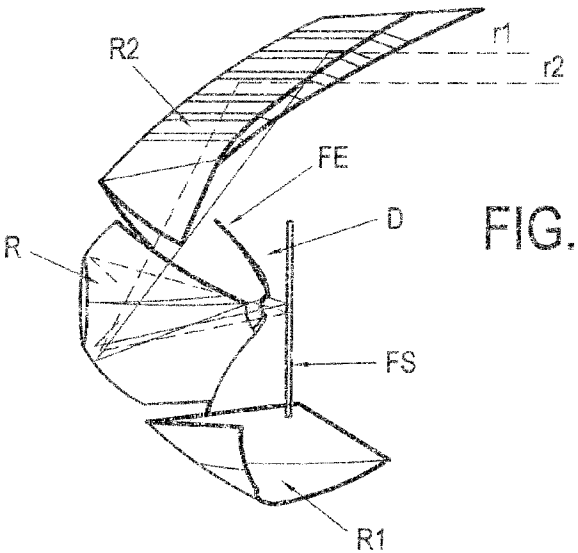

In the case of the comparative optical module as depicted in FIGS. 3A and 3B, the optical deviation element D is therefore vertical, that is to say the exit face of the optical deviation element D is in a vertical plane, which is perpendicular to the optical axis Y of the main reflector R. There are then unfavorable "stray" ray paths. There are first of all rays coming from the light source S and returned by the central part of the main reflector R. These rays make an outward and return trip in the optical deviation element D, being reflected partially on the exit face FS thereof. Next, these rays come to be reflected once again on the central part of the main reflector R, either in the same area or in a symmetrical area. Finally, these rays are returned by one of the two supplemental reflectors R1, R2 towards the front of the optical module MO above the cutoff.

There are also stray rays coming from the light source S, returned by the central part of the main reflector R, and which this time are partially reflected on the entry face FE of the optical deviation element D. Next, these rays come to be reflected once again on the central part of the main reflector R and follow the same type of path as before.

Everything happens as if all the stray rays create a second virtual light source in an area where the stray rays converge before "starting off again" towards the supplemental reflectors R1 or R2. This second source is in fact a highly deformed image of the filament of the real light source S (the zone situated at the intersection of the two rays r1 and r2 in FIG. 3B), which is situated below the horizontal plane containing the filament of the light source S which, for its part, is situated at the focus of the main reflector R. The stray rays then emerge from the optical module MO above the cutoff, above the horizontal represented by the two lines l1, l2 in FIG. 3B.

Two paths of these rays r1 and r2, by way of example, are shown in FIGS. 3A and 3B.

Figure 4:
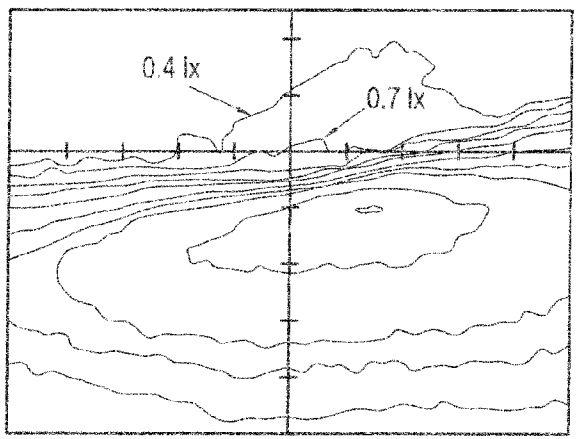
FIG. 4 is an isolux curve of a light beam obtained with the comparative optical module of the previous figures.

In this configuration, the dipped function obtained therefore is not optimal, since it has rays above the oblique cutoff at 15° regulatory. FIG. 4 illustrates the corresponding isolux curves, as measured at 25 meters in front of the optical module MO. There can be seen in the axis of the target light rays above 0.7 lux.

According to the invention, and as depicted in FIGS. 5A and 5B, the top edge of the optical deviation element D is slightly inclined towards the front.

FIG. 5A superimposes the vertical configuration of the optical deviation element D (comparative module) and the inclination of this by an angle alpha (α) according to the invention. Here, the simplest configuration is chosen: the angle alpha (α) is measured by the angular separation of the plane of the exit face FS of the optical deviation element D with respect to the vertical. The exit face FS of the lens is tangent to the plane P1 forming an angle alpha (α) with respect to the plane P0 that is normal to the optical axis Y and in fact vertical.

Figure 6A:
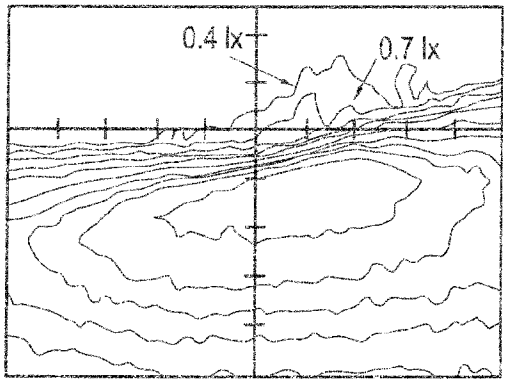
FIGS. 6A, 6B and 6C are isolux curves of a light beam obtained with two variants of optical modules according to the teaching of the invention.
Figure 6B:
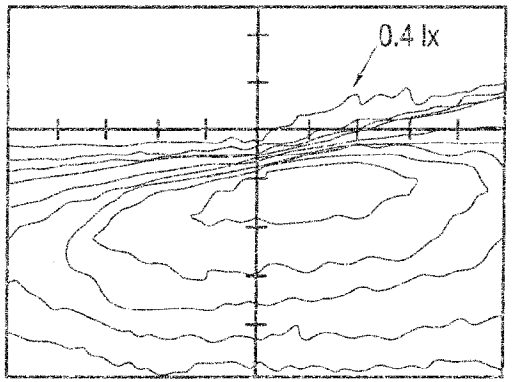
Figure 6C:
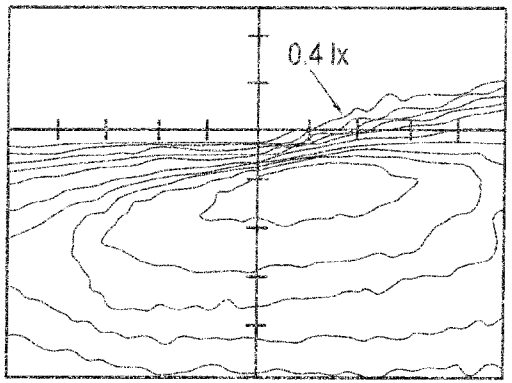

A very small inclination suffices to have a significant impact on the path of the stray rays described above: FIGS. 6A, 6B and 6C show the isolux curves obtained of the dipped functions, always measured at 25 meters in front of the optical module MO with, for FIG. 6A, an angle alpha (α) of 2°, for FIG. 6B an angle alpha (α) of 4°, and for FIG. 6C an angle alpha (α) of 5°. As from an inclination of 2° (FIG. 6A), an improvement can be seen compared with a standard vertical positioning of the optical deviation element D (FIG. 4): the value in the axis is situated just below the threshold of 0.7 lux regulatory. With an inclination of 4° (FIG. 5B), the value in the axis is this time well below the 0.7 lux regulatory, in fact substantially below 0.4 lux. An inclination at 5° affords a further improved effect (FIG. 6C), since the "protrusion" that slightly deformed the area at 15° of the cutoff has also disappeared.

Here the virtual light source still exists but this time is situated above the horizontal plane containing the filament of the light source S. The stray rays then leave the optical module MO below the cutoff: on the one hand dazzling in the position of a beam with cutoff of the dipped type position is avoided, and on the other hand more light is recovered in order to make this same dipped beam.

Figure 7:
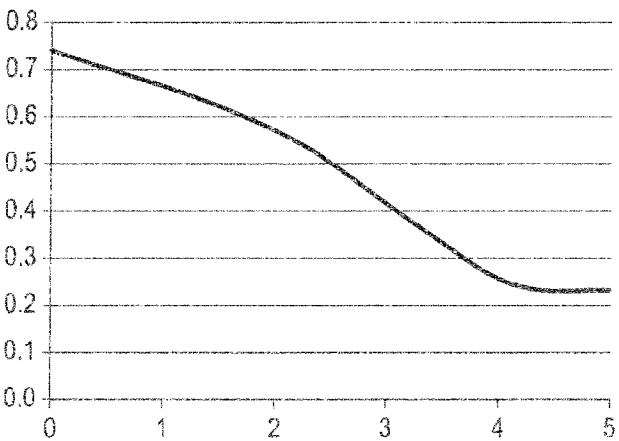
FIG. 7 is a graph showing the variation in intensity of the stray rays above the cutoff of a beam with cutoff according to the inclination of the lens of the optical modules of the previous figures.

FIG. 7 shows the change in the quantity of stray rays arriving above the cutoff of a dipped beam (Y axis in lux) generated by an optical module as described above, according to the angle alpha chosen (X axis in degrees): it is verified that the angle alpha (α) is preferably at least 2° or 3° in order to be truly effective. Moreover, it has been shown that an inclination of 10° or 12° at a maximum is recommended, since beyond this the edges of the beam tend to "rise".

FIG. 8A shows a front view of two adjacent cavities of a headlight (cavity shown separately for more convenience, but which are in fact contiguous): the cavity that is situated to the right of the figure is the one containing the optical deviation element D and its two supplemental reflectors R1 and R2 of the type described above. FIG. 8B is a perspective view of the two cavities, and FIG. 8C is a cross-section of the right-hand cavity passing through the lamp, which shows the inclination of the square lens by an angle of approximately 5°, so that its top edge is further forward than its bottom edge.

Figure 9:
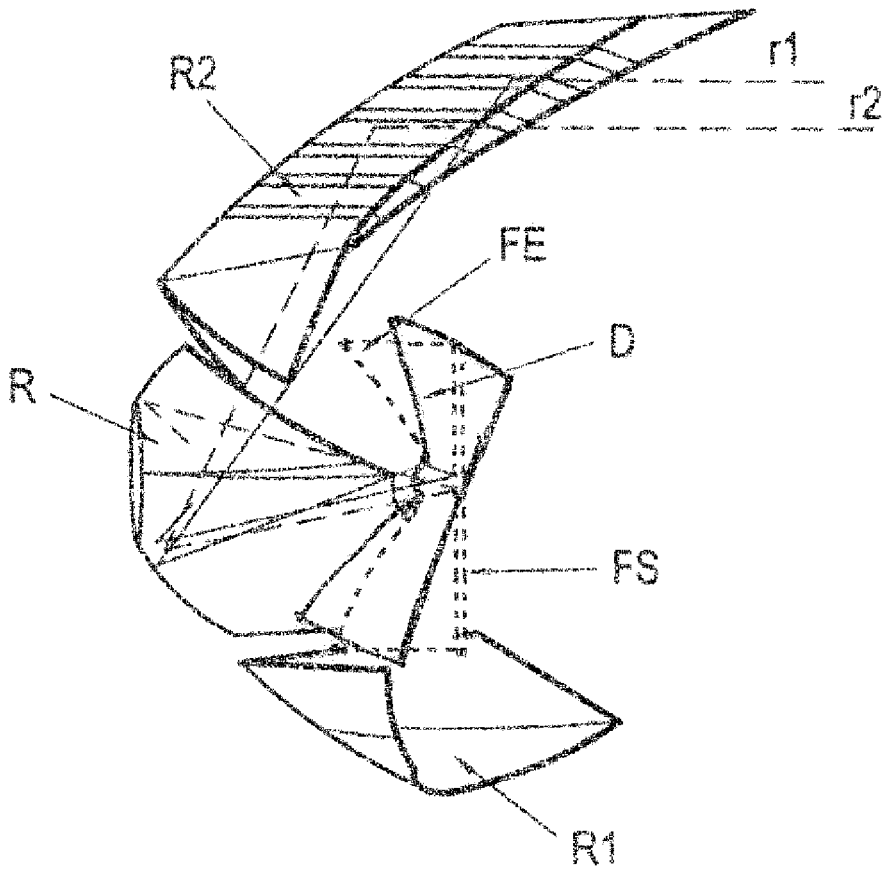
FIG. 9 is a view similar to FIG. 3A showing a lateral edge more forward an opposite lateral edge.

Another example according to the invention, shown in FIG. 9, showing making the lens turn slightly (shown in solid line) with respect to a substantially vertical axis perpendicular to the optical axis: this rotation also makes it possible to resorb the stray rays. A comparison of the tilted optical deviation element D (shown in solid line in FIG. 9) to the optical deviation element D when it is in a non-turned view is shown by the dashed line. It is preferably carried out, in plan view, in the anticlockwise direction for a dipped beam adapted for traffic on the right, and in a clockwise direction for a dipped beam adapted for traffic on the left. This rotation may be of approximately 1° to 5°. The direction of rotation may be reversed in certain configurations.

In conclusion, these various results demonstrate the effectiveness of inclining the lens compared with its normal configuration. This inclination, which remains moderate, also keeps the normal visual appearance of this type of optical module.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. An optical module for a motor vehicle headlight comprising:

a reflector having an optical axis and at least one focus, a light source placed in the vicinity of said at least one focus of said reflector, and a transparent optical deviation element placed in front of part of said reflector and comprising a lens, said reflector being placed at a rear of said lens, said transparent optical deviation element being rotated to provide a substantially horizontal spread of the light, wherein a first face of said lens lies in a plane that is tangent to said optical axis of said reflector is substantially disposed along a horizontal axis, with at least one of said first face of said lens or a second face of said lens having vertical generatrices disposed obliquely with respect to said plane by an angle different from ninety degrees, wherein said vertical generatrices of said first face and said second face remain substantially parallel after such rotation and a direction of said light source not being substantially affected by such rotation.

2. The optical module according to claim 1, wherein a wall of said reflector comprises at least one cutout on one side of a plane passing through said optical axis of said reflector, and that at least one second reflector is disposed on a side of said at least one cutout opposite to said optical axis, and said at least one second reflector being designed to collect at least part of the light coming from said light source emerging through said at least one cutout, and to produce a supplementary beam that is not intercepted by said lens.

3. The optical module according to claim 1, wherein a plane tangent to said first face and/or to vertical generatrices of said second face of said lens is inclined by at least 1.5°, with respect to a plane passing through the normal to said optical axis and cutting said plane on said optical axis.

4. The optical module according to claim 3, wherein a plane tangent to said first face of said lens and/or to vertical generatrices of said second face of this is inclined by no more than 12°, with respect to a plane passing through the normal to said optical axis and cutting said plane on said optical axis.

5. The optical module according to claim 1, wherein a plane tangent to said first face of said lens and/or to vertical generatrices of said second face thereof is inclined by an angle of between 4° and 6° with respect to the plane passing through the normal to said optical axis and cutting said plane on said optical axis.

6. The optical module according to claim 1, wherein a plane tangent to said first face and/or to vertical generatrices of said second face of said lens is inclined with respect to the plane passing through the normal to said optical axis and cutting said plane on said optical axis an angular difference being measured positively above said optical axis.

7. The optical module according to claim 1, wherein a plane normal to said optical axis is substantially vertical, said optical module being mounted in the vehicle.

8. The optical module according to claim 1, wherein a top edge of said lens is further forward than a bottom edge with respect to the general direction of travel of light emitted by said light source, said optical module being mounted in the vehicle.

9. The optical module according to claim 1, wherein at least one lateral edge of said lens is further forward than an opposite lateral edge, with respect to the general direction of travel of the light emitted by said light source, said optical module being mounted in the vehicle.

10. The optical module according to claim 1, wherein a wall of said reflector comprises two cutouts situated on each side of a plane passing through said optical axis, in particular respectively above and below the horizontal plane passing through said optical axis or respectively to the right and to the left of a vertical plane passing through said optical axis, at least one supplementary reflector being associated with each cutout and disposed on the side of a cutout opposite to said optical axis in order to produce a supplementary beam that is not intercepted by said lens.

11. The optical module according to claim 1, wherein each of said two cutouts is associated with two supplementary reflectors, each of said two supplementary reflectors being asymmetric.

12. The optical module according to claim 11, wherein each of said two supplementary reflectors have either different focal lengths or focal lengths of at least 10 mm.

13. A motor vehicle headlight including an optical module according to claim 1.

14. An optical module for a motor vehicle headlight, said optical module comprising:

a reflector having an optical axis and at least one focus, a light source placed in the vicinity of said at least one focus of the reflector, and a lens in front of said reflector for providing a substantially horizontal spread of the light, wherein, at least one of a first face or a second face of said lens is generally tangent to a plane disposed obliquely with respect to said optical axis and said second face that forms an angle with respect to a plane that is normal to said optical axis wherein at least one of said first face or said second face comprises vertical generatrices obliquely oriented with respect to said plane by an angle different from ninety degrees, wherein said vertical generatrices of said first face and said second face remain substantially parallel after such rotation and a direction of said light source not being substantially affected by such rotation.

15. The optical module according to claim 14, wherein vertical generatrices of said second face of said lens are disposed in a plane disposed obliquely with respect to said optical axis.

16. The optical module according to claim 15, wherein a wall of said reflector comprises at least one cutout on one side of said plane passing through said optical axis of said reflector, and at least one supplementary reflector is disposed on a side of a cutout opposite to said optical axis, said at least one supplementary reflector being designed to collect at least part of the light coming from the light source emerging through said cutout and to produce a supplementary beam that is not intercepted by said lens.

17. The optical module according to claim 14, wherein a plane tangent to said first face and/or to the vertical generatrices of said second face is inclined by at least 1.5°, with respect to a plane passing through the normal to said optical axis and cutting said plane on said optical axis.

18. The optical module according to claim 17, wherein the plane tangent to said first face of said lens and/or to the vertical generatrices of said second face of this is inclined by at most 12°, in particular no more than 10°, with respect to a plane passing through the normal to the optical axis and cutting said plane on said optical axis.

19. The optical module according to claim 14, wherein said first face is an exit face and said second face is an entry face.

20. An optical module for a motor vehicle headlight comprising:

a reflector having an optical axis and at least one focus, a light source placed in the vicinity of said at least one focus of the reflector, and a transparent optical deviation element placed in front of part of the reflector and comprising a lens having a cylindrical face with vertical generatrices, said reflector being placed at the rear of said lens, said transparent optical deviation element being rotated to provide a substantially horizontal spread of the light, wherein an exit face of said lens being generally tangent to a plane disposed obliquely with respect to said optical axis and said optical axis of said reflector being substantially disposed along a horizontal axis, with said cylindrical face being inclined with respect thereto by an angle different from ninety degrees and wherein said vertical generatrices are disposed obliquely with respect to said planes, wherein said vertical generatrices of said first face and said second face remain substantially parallel after such rotation and a direction of said light source not being substantially affected by such rotation.

21. The optical module according to claim 1, wherein said first face is an exit face and said second face is an entry face.

* * * * *